United States Patent [19]

McCleskey

[11] 3,940,099

[45] Feb. 24, 1976

[54] APPARATUS FOR USE IN ERECTION OF TENT OR OTHER SHELTER ADJACENT A VEHICLE

[76] Inventor: Hubert D. McCleskey, 5715 Effingham, Houston, Tex. 77035

[22] Filed: July 11, 1974

[21] Appl. No.: 487,566

[52] U.S. Cl. ..... 248/38; 135/1 A; 135/3 A; 248/44; 135/15 PQ

[51] Int. Cl.[2]A45F 1/16; A01K 97/08; A45G 33/12; G09F 17/00

[58] Field of Search ..... 135/1 A, 3 A, 4 A, 5 A, 135/7.1 A, 15 R, 15 PQ; 15/144 A, 229 BP; 248/38, 44

[56] References Cited

UNITED STATES PATENTS

| | | | |
|---|---|---|---|
| 1,257,486 | 2/1918 | Honeycutt | 135/15 PQ |
| 2,480,509 | 8/1949 | Ripley | 135/1 A |
| 2,875,460 | 3/1959 | Legge | 15/144 A |
| 2,967,320 | 1/1961 | Short | 15/229 BP |
| 2,989,967 | 6/1961 | Lee | 135/1 A |
| 3,082,456 | 3/1963 | Short | 15/229 BP |

*Primary Examiner*—Werner H. Schroeder
*Assistant Examiner*—Conrad L. Berman
*Attorney, Agent, or Firm*—Donald Gunn

[57] ABSTRACT

A device for use in erecting a tent or shelter of other construction adjacent to a vehicle which incorporates a base plate for supporting a tent pole. The base plate is preferably relatively small, but is sufficiently large to rest on the ground and support a tire on the base plate. The device is adapted to be placed on the ground and an adjacent vehicle is moved to position the tire on top of the device. This fixes the device quickly without the necessity of driving stakes or the like. The base plate is fixed in position and supports a generally upright rotatably mounted socket with guy-wires. The wires are selectively rigged to fix the socket at the desired angle. The socket receives a tent pole for support of a tent or shelter. Preferably, two are provided for a given shelter and one is positioned beneath each wheel on the side or rear of the vehicle.

2 Claims, 4 Drawing Figures

APPARATUS FOR USE IN ERECTION OF TENT OR OTHER SHELTER ADJACENT A VEHICLE

PRIOR ART

United States Patents

| | |
|---|---|
| 3,186,420 | 2,571,362 |
| 3,018,783 | 2,926,677 |
| 3,324,869 | 3,228,405 |

BACKGROUND OF THE INVENTION

It is often quite difficult to rig a tent or other shelter adjacent a vehicle while on a camping excursion. It is difficult to set tent poles and drive pegs in some soil and cause them to hold a conventional tent or shelter. The present invention has been provided with these problems in view.

SUMMARY OF THE INVENTION

The present invention incorporates a base plate or structure which is adapted to be placed on the ground and held in position by a tire of a vehicle. The base is sufficiently large to receive a tire thereon, which clamps the base. In the preferred embodiment the base is triangular and has frame members along one side which are adapted to receive and support the tire. A frame member extends across one portion of the base. It is preferably of tubular construction and receives a surrounding elongate tubular member thereabout. The larger tubular member is rotatable and has an outwardly projecting tab. The tab is connected with a bifurcated clamp at the base of a socket. The socket rotates with 2° of freedom. Its rotation enables the user to position the base to direct the socket upwardly at a specified angle. Preferably, flexible cables engage a shoulder or otherwise connect to the socket to position it at a specified angle to hold or maintain that angle. This enables the socket to receive the lower end of a tent pole in the erection of a tent or shelter. Two bases are provided, one under each tire.

DESCRIPTION OF THE PREFERRED EMBODIMENT

Figure 1:
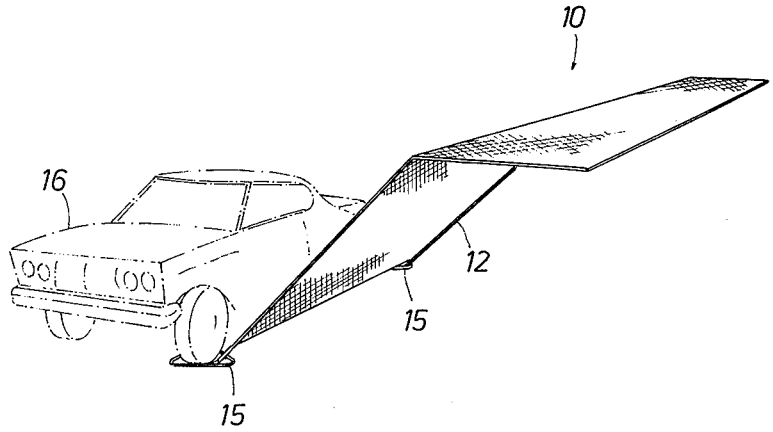
FIG. 1 shows a tent or shelter erected using the base of the present invention which is clamped between the supporting surface and the tire of a vehicle.

Attention is first directed to FIG. 1 where a shelter 10 is erected on an upright pole 12 supported by the present invention 15. A vehicle 16 rests on the base 15 and clamps it in position. The vehicle 16 provides weight through its tires, which rest on the base plate 15. The weight clamps the base plate against the soil to secure the tent or shelter 10 in a useful position.

Figure 2:
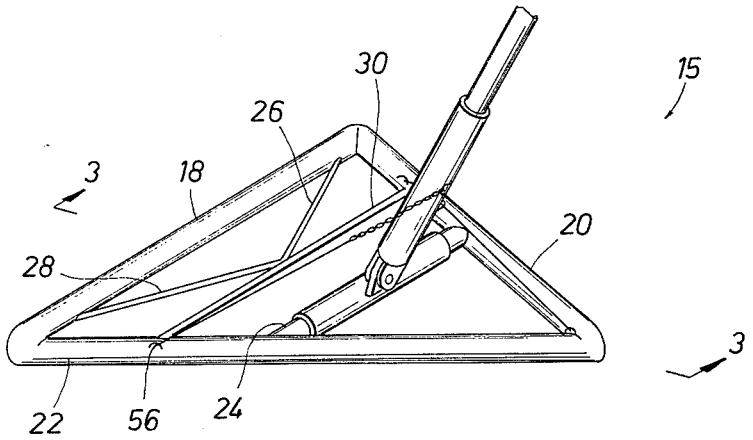
FIG. 2 is an enlarged perspective view of the shelter anchor of the present invention, including a tent pole arranged in the socket.

Attention is directed to FIG. 2 where the apparatus 15 is shown in greater detail. It is preferably formed of a triangular framework and includes sides which are approximately equal in length. The sides are identified at 18, 20 and 22. A tubular member 24 parallel to the side 18 is arranged between the sides 20 and 22. The members 18, 20, 22 and 24 are all preferably formed of stock of the same size and weight. Tubular stock is preferred.

The apparatus 15 supports the tire of a vehicle as shown in FIG. 1. The tire weight is supported on a number of frame members located inside the triangle of the apparatus. Frame members 26, 28 and 30 are preferably located away from the tubular member 24, and to this end, they are preferably close to the side 18. This construction of frame members within the triangle specifies an arrangement whereby the tire of the vehicle is supported on the framework which has an effective width and length larger than the print of the tire. The framework is somewhat wider and longer than the surface area of the tire when contacted against the ground. The device is adapted to be used on firm ground as well as sand. In the event it is used on sand, it may sink into the ground, but this is no detriment to operation of the apparatus.

As described to this juncture, the base 15 includes a triangular shape which has framework along one side adapted to support and receive the weight of a vehicle transferred against it by a tire which is driven over the framework. This enables the device to be used easily. It is placed on the ground at a desired location and the vehicle is driven forwardly or backwardly to a point midway between the frame members 26, 28 and 30. This clamps the triangular apparatus 15 with a portion of it extending to the side of the vehicle where it can be easily engaged by the user. Easy access to the remaining portion enables quick erection of the shelter 10.

The tubular member 24 supports an elongate sleeve 34. The sleeve 34 is slidably and rotatably positioned on the tubular member 24. The sleeve 34 supports an upstanding tab 36 which is perforated at a central opening. The tab 36 is surrounded by a bifurcated clamp 38 which has a pair of spaced perforated tabs. All three members have openings which are preferably of the same size and aligned with one another at the time of assembly. A bolt 40 extends through the three openings to attach the socket to be described to the tab 36. The bolt 40 is made fast by use of a winged nut 42.

The bifurcated clamp supports a socket 44. The socket 44 is welded to it and comprises an upwardly opening tubular member of relatively short length. The socket 44 is hollow and open at its upper end as shown in dotted line in FIG. 3. It is undercut by a notch 46 and has an adjacent eyelet 48. The eyelet 48 enables connection of the socket to a flexible cable 50 which is tied to the apex determined by the sides 20 and 22 of the framework.

Figure 3:
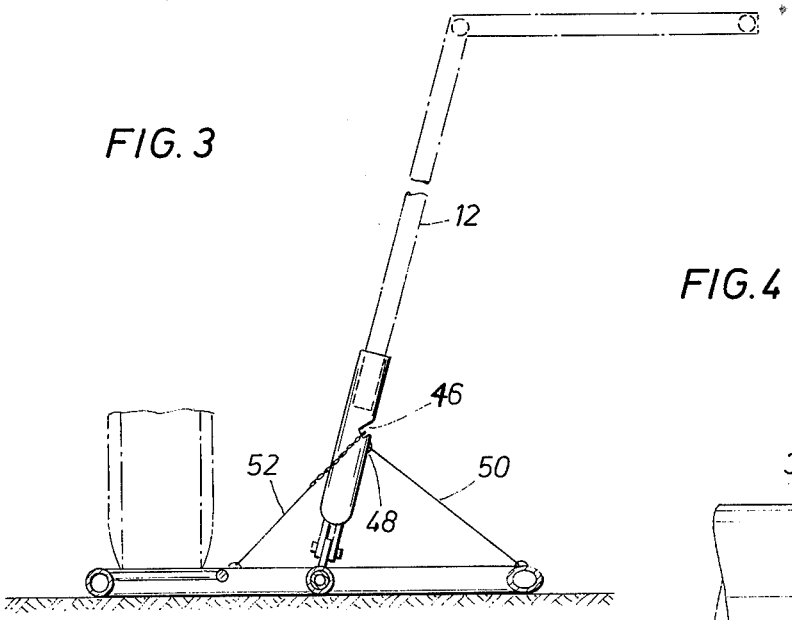
FIG. 3 is a sectional view taken along the line 3—3 of FIG. 2 showing details of construction of the base which is supported on the ground; and, FIG. 4 is an enlarged detail view of the lower end of the socket showing an arrangement by which its pivotal installation is achieved.
Figure 4:
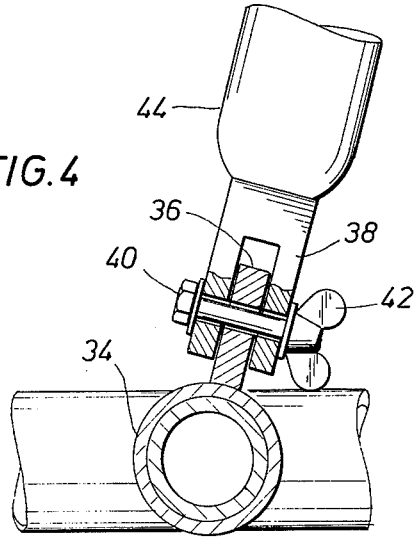

As shown in FIG. 3, the flexible cable limits the counterclockwise rotation of the socket about the rotatable sleeve 34.

The socket can lay down against the framework on clockwise rotation from the position of FIG. 3. It is selectively anchored in the up or elevated position of FIG. 3 by use of a flexible member 52. The flexible member 52 is anchored at 56 in FIG. 2 with an eyelet on one of the two sides of the triangle extending to the apex where the cable 50 is connected. The other end of the flexible member 52 is connected to a symetrically located eyelet. The flexible member 52 is selectively looped through the notch 46. It can be removed from the notch 46. It is preferably installed with one end permanently tied to the connective eyelet and the other end selectively removed from its appropriate eyelet by use of a snap swivel or some other suitable means for achieving disengagement. At the time of completion of installation, this leaves the socket 44 tied with three guy-wires which fix it in position and prevent subsequent rotation. The socket, when held at this position, readily receives a tent or shelter pole 12 of appropriate length and shape to support the tent or shelter 10 at a convenient and readily useable location.

Installation of the apparatus is achieved simply. The triangular base 15 is laid on the ground adjacent to the wheels along one side of the vehicle. The vehicle is driven the necessary distance to position the wheels above the triangular base and position the base indefinitely. When this is accomplished, the base is installed. After the base has been installed, the rotatable socket is positioned in a near upright position which is shown approximating a 75° angle with respect to the plane of the base 15. It is rotated to this position and the flexible member 50 is pulled taut. The flexible member 52 is looped through the notch 46 and made fast at its free end by means of connecting a snap swivel with an eyelet fixed to the triangular frame. The socket is then appropriately located and is easy to handle because of its relatively light weight. The pole 12 is then inserted into the upper end of the socket. A snug or friction fit secures the two members and the shelter is then ready for erection. Disassembly is achieved in the reverse sequence and the apparatus is quickly dismantled.

The scope of the present invention is determined by the appended claims.

I claim:

1. A shelter support apparatus for use with a vehicle supported on at least two tires, comprising:

a generally planar base member having an exposed upper face of size adequate to receive thereon the print of a tire on a vehicle to weight said base in a fixed position, said base member having a structural frame member extending from its face such that it is laterally of the tire on said face;

a pivotally mounted rotatable upwardly opening bayonet socket carried on said from member and mounted for rotation about a selected axis;

an elongate pole adapted to support a shelter and having a lower end portion releasably connected into said socket for support thereof above said base;

a flexible cable means connected to said base member and said socket to control its angle of rotation about the selected axis and hence the position of said pole; and, a second flexible cable means connected to said base and said socket member for limiting the angle of said socket in cooperation with said first flexible cable means wherein the second cable means acts oppositely of said first cable means.

2. The apparatus of claim 1 wherein said base member includes a triangular frame around a face plate for the tire and said frame is adapted to encircle the tire at its point of contact with said face plate.

* * * * *